US011286568B2

(12) United States Patent
Xu et al.

(10) Patent No.: US 11,286,568 B2
(45) Date of Patent: Mar. 29, 2022

(54) FILM FORMING TREATMENT AGENT FOR COMPOSITE CHEMICAL CONVERSION FILM FOR MAGNESIUM ALLOY, AND FILM FORMING PROCESS

(71) Applicant: BAOSHAN IRON & STEEL CO., LTD., Shanghai (CN)

(72) Inventors: Shiwei Xu, Shanghai (CN); Weineng Tang, Shanghai (CN); Xiaobo Chen, Shanghai (CN); Cong Ke, Shanghai (CN); Nick Birbilis, Clayton (AU); Haomin Jiang, Shanghai (CN); Pijun Zhang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 65 days.

(21) Appl. No.: 16/060,156

(22) PCT Filed: Dec. 6, 2016

(86) PCT No.: PCT/CN2016/108675
§ 371 (c)(1),
(2) Date: Jun. 7, 2018

(87) PCT Pub. No.: WO2017/101711
PCT Pub. Date: Jun. 22, 2017

(65) Prior Publication Data

US 2018/0363145 A1 Dec. 20, 2018

(30) Foreign Application Priority Data

Dec. 14, 2015 (CN) ..... 201510926268.2

(51) Int. Cl.
*C23C 22/22* (2006.01)
*C23C 22/83* (2006.01)
(Continued)

(52) U.S. Cl.
CPC ..... *C23C 22/22* (2013.01); *C23C 22/73* (2013.01); *C23C 22/78* (2013.01); *C23C 22/83* (2013.01)

(58) Field of Classification Search
CPC ..... C23C 22/22; C23C 22/73; C23C 22/83; C23C 22/78
See application file for complete search history.

(56) References Cited

U.S. PATENT DOCUMENTS

2011/0269022 A1* 11/2011 Kawakami ..... B60L 50/64 429/221
2013/0156678 A1* 6/2013 Banerjee ..... B82Y 30/00 423/445 R
(Continued)

FOREIGN PATENT DOCUMENTS

CN 103556136 A 2/2014
CN 103628050 3/2014
(Continued)

OTHER PUBLICATIONS

JP 2014084500 A English translation. (Year: 2020).*
(Continued)

*Primary Examiner* — Hai Y Zhang
(74) *Attorney, Agent, or Firm* — Lei Fang; Smith Tempel Blaha LLC

(57) ABSTRACT

A film forming treatment agent for a composite chemical conversion film for magnesium alloy, and a film forming process method, and a composite chemical conversion film are provided. Components of the film forming treatment agent for a composite chemical conversion film for magnesium alloy comprise a water solution and a suspension of reduced graphene oxide flakes to the water solution. The water solution comprises strontium ions at 0.1 mol/L to 2.5 mol/L and phosphate ions at 0.06 mol/L to 1.5 mol/L, and pH of the water solution is 1.5 to 4.5. Concentration of the
(Continued)

reduced graphene oxide varies between 0.1 mg/L and 5 mg/L. The film forming process method for a composite chemical conversion film for magnesium alloy comprises the following steps of: 1) pretreatment on surface of magnesium alloy matrix; 2) immersion of magnesium alloy matrix in the film forming treatment agent; and 3) removal of magnesium alloy pieces for drying in air. The composite chemical conversion film for magnesium alloy is formed by immersing magnesium alloy matrix in the film forming treatment agent. The composite chemical conversion film for magnesium alloy has excellent corrosion-resistance performance in 3.5 wt % NaCl solution.

11 Claims, 10 Drawing Sheets

(51) Int. Cl.
*C23C 22/73* (2006.01)
*C23C 22/78* (2006.01)

(56) References Cited

U.S. PATENT DOCUMENTS

2014/0065368 A1* 3/2014 Aytug ..... B32B 33/00 428/142
2014/0370246 A1* 12/2014 Hurt ..... B32B 37/14 428/189
2015/0231606 A1* 8/2015 Tsukada ..... B01J 35/004 502/340
2015/0232671 A1* 8/2015 Silvernail ..... B05D 3/002 428/471

FOREIGN PATENT DOCUMENTS

CN 104178721 A 12/2014
CN 104342678 2/2015
CN 104629603 5/2015
CN 104630528 5/2015
CN 104888271 9/2015
CN 104988485 A 10/2015
JP H0471454 3/1992
JP H08134662 5/1996
JP H10183364 7/1998
JP H11264078 9/1999
JP 2001288580 10/2001
JP 2003003273 1/2003
JP 2005256064 9/2005
JP 2011508089 3/2011
JP 2014084500 5/2014

OTHER PUBLICATIONS

Search Report dated Jul. 10, 2018 for Chinese Patent Application No. 201510926268.
First Office Action dated Jul. 18, 2018 for Chinese Patent Application No. 201510926268.
Second Office Action dated Jan. 29, 2019 for Chinese Patent Application No. 201510926268.
Notice of Allowance dated Apr. 29, 2019 for Chinese Patent Application No. 201510926268.
Search Report dated Apr. 15, 2019 for European Application No. 16874768.
Intention to Grant dated Dec. 2, 2019 for European Application No. 16874768.
Office Action dated May 21, 2019 for Japanese Patent Application No. 2018-529654.
Decision to Granted dated Nov. 12, 2019 for Japanese Patent Application No. 2018-529654.
International Search Report and Written Opinion dated Jun. 22, 2017 for PCT Patent Application No. PCT/CN2016/108675.
Office Action dated Dec. 3, 2019 for Korean Patent Application No. 20187014937.
Office Action dated Aug. 19, 2019 for Korean Patent Application No. 20187014937.
Office Action dated Apr. 12, 2019 for Australian Patent Application 2016372757.
Cao, Y., ; et al. (2004) "Liquid surface conditioning agent." Materials Protection(China) vol. 37, No. 5.
Cao, Y. et al., "Research on liquid surface conditioning agent," Material Protection, 2004, vol. 37(5), 2 pages.

* cited by examiner

FILM FORMING TREATMENT AGENT FOR COMPOSITE CHEMICAL CONVERSION FILM FOR MAGNESIUM ALLOY, AND FILM FORMING PROCESS

CROSS-REFERENCE TO RELATED APPLICATIONS

This is a national stage filing in accordance with 35 U.S.C. § 371 of PCT/CN2016/108675 filed Dec. 6, 2016, which claims the benefit of the priority of Chinese Patent Application No. 201510926268.2 filed Dec. 14, 2015, the contents of each are incorporated herein by reference.

TECHNICAL FIELD

The present invention relates to a film forming treatment agent and a film forming process, in particular to a film forming treatment agent for an environmentally friendly composite chemical conversion film for magnesium alloys and a film forming process thereof.

BACKGROUND ART

Magnesium alloys are emerging lightweight materials. Magnesium alloys are widely used in manufacturing fields such as automobiles and airplanes due to their advantages such as excellent high specific strength and specific rigidity, excellent electromagnetic shielding performance, easy cutting, easy recovery, and abundant natural reserves. Therefore, magnesium alloys are also known as "green engineering materials of the 21st century". However, although corrosion resistance of magnesium alloys is higher than that of pure magnesium, magnesium alloys still have the disadvantage of poor corrosion resistance, compared with other alloys. Hence, the biggest challenge in the widespread application of magnesium alloys as engineering materials in manufacturing fields is how to effectively improve their corrosion resistance. It should be noted that many methods in prior art for reducing corrosion of other metals are not applicable to magnesium alloys.

As an important corrosion protection method, surface modification technology can improve the corrosion resistance of magnesium and its alloys by isolating magnesium alloys from corrosive environments through generating a protective film on the surface of magnesium and its alloys. Methods of improving the corrosion resistance of magnesium and its alloys by surface modification techniques include: chemical conversion film, inert metal plating coating, micro-arc oxidation, anodization, hybrid material, organic coating, and the like. Among these, the chemical conversion film processing technology has the advantages of being simple and easy, requiring no special equipment, suitable for complex structures and large-scale workpieces and the like. Meanwhile, the chemical conversion film is widely used in related manufacturing fields because it can significantly reduce the manufacturing cost.

At present, many chemical conversion film technologies have been studied to improve the corrosion resistance of magnesium and its alloy materials. Various chemical conversion film technologies in prior art cannot be effectively extended to large-scale industrial production fields due to their own inherent deficiencies. For example, a chemical conversion film mainly composed of stannate, rare earth metal salt, ionic liquid and hot-melt salt has a long preparation time and a high raw material cost; the use of chromates, fluorides, and citrates in many countries and regions is prohibited due to their high toxicity to human body and natural environment; chemical conversion films consisting mainly of stearic acid requires very high reaction temperatures. Compared with the above-mentioned chemical conversion film technologies, the phosphate chemical conversion film technology has the advantages of relatively low production cost and small impact on environment, and is therefore more welcomed in the industrial production and manufacturing field. However, conventional phosphate chemical conversion film technologies only can provide limited protection ability for magnesium and magnesium alloys. Moreover, the solution composition of some phosphate chemical conversion films has specific requirements for the environment in which the magnesium alloy material coated with the chemical conversion film are located. For example, calcium phosphate chemical conversion film products can only remain stable within a range wherein pH changes are minimal. Therefore, the use of such chemical conversion film technology in engineering technology is greatly restricted.

Chinese Patent (Publication No. CN1475602A, Publication date: Feb. 18, 2004) entitled "Preparation method of magnesium alloy chrome-free chemical conversion film and film forming solution" discloses a preparation method of magnesium alloy chrome-free chemical conversion film and film forming solution. The preparation method includes: 1) mechanical pretreatment: grinding and removing foreign matter; 2) degreasing: washing with alkaline solution; 3) pickling: washing with acidic solution to remove surface oxides; 4) activation or finishing: removing very thin oxidized film and pickling ash from its surface with fluorine-containing acidic solution at a temperature of 20-60° C.; 5) film forming: immersing the pretreated magnesium alloy sample in a film forming solution to obtain a phosphate chemical conversion film; 6) after treatment: immersing in alkaline aqueous solution at a temperature of 15-100° C. for 3-60 min, further closing inner pores of the conversion film to obtain a finished product; The composition of the film forming solution is consisted of manganese salt, phosphate, fluoride and water in a ratio of 1:1-5:0-0.5:10-200. Although the film forming solution disclosed in the above Chinese patent has good corrosion resistance and film adhesion, its preparation process is relatively complex and requires fluorine-containing acidic solution during the preparation process, which impacts the working environment to some extent.

US Patent (Publication No. US20040001911A, Publication date: Jan. 1, 2004) entitled "Antibiotic calcium phosphate coating" discloses a chemical conversion film mainly composed of a hydroxyapatite crystalline fiber formed by steam spraying a solution containing a hydroxyapatite component on the metal surface and then cooling. Because the preparation process of the chemical conversion film disclosed in the above US Patent is relatively complicated and strict in implementation requirements, it cannot be widely applied to the industrial field.

In summary, the industrial field expects to obtain a chemical conversion film technology that is low in cost, friendly to the environment, has good corrosion resistance, and is quick and easy to prepare, so that it can be widely used in industrial manufacturing field.

SUMMARY OF THE INVENTION

One object of present invention is to provide a film forming treatment agent for a composite chemical conversion film for magnesium alloy. Such film forming treatment agent does not contain chromate and fluoride and is non-toxic and economical. In addition, the film layer formed on the surface of the magnesium alloy material by the film forming treatment agent has good corrosion resistance and excellent stability.

To achieve the above object, the present invention provides a film forming treatment agent for a composite chemical conversion film for magnesium alloy, which comprises aqueous solution and a reduced graphene oxide insoluble to the aqueous solution; wherein the aqueous solution comprises strontium ions at 0.1 mol/L to 2.5 mol/L and phosphate ions at 0.06 mol/L to 1.5 mol/L, pH value of the aqueous solution is 1.5-4.5; and concentration of the reduced graphene oxide is 0.1 mg/L to 5 mg/L.

According to technical solutions of present invention, the film forming treatment agent described above includes aqueous solution and a reduced graphene oxide insoluble to the aqueous solution. Since the film forming treatment agent does not contain chromate and fluoride, the film forming treatment agent is non-toxic and environmentally friendly:

Applicants have discovered that a phosphate chemical conversion film can provide certain protection for magnesium alloys. In particular, strontium phosphate itself has a good chemical stability, thereby can maintain stable in a range where the pH changes are large and provide protection for metal surface.

The preparation solution for preparing the salt should contain 0.1-2.5 mol/L strontium ions and 0.06-1.5 mol/L phosphate ion. The reaction rate of the chemical conversion film increases as the concentration of strontium ions and phosphate ions in the film forming treatment agent increase. However, the increase in the concentration of strontium ions and phosphate ions will narrow the pH range in which a stable chemical conversion film can be obtained, thereby increase the difficulty of converting the film forming treatment agent into a chemical conversion film. In addition, when the concentration of strontium ions or phosphate ions is too high, other impurities may be easily generated to cause defects. When the concentration of strontium ions or phosphate ions is too low, the amount of salt formed is too small to produce a dense film layer. Therefore, the present invention uses 0.1-2.5 mol/L and 0.06-1.5 mol/L, respectively.

Also, a selection for the concentration of strontium ions, phosphate ions, and the pH value of aqueous solution depends on the optimal balance between product quality and production rate of the magnesium alloy.

After the reduced graphene oxide is added, the hydroxy strontium phosphate further forms a composite with the graphene oxide during its formation and then co-precipitates on the surface of the magnesium alloy matrix to form a dense and corrosion-resistant composite coating. The concentration of the reduced graphene oxide is 0.1-5 mg/L. If concentration is too high, density and adhesion of the film layer will be significantly reduced, which is against the corrosion resistance. The reasons for setting the pH value of aqueous solution to be between 1.5 and 4.5 are as follows: generally, the film forming agent coated on the surface of magnesium alloy reacts at a fast rate under a relatively low pH condition (i.e. under the weak acid condition). When the pH value of the aqueous solution is too low, the reaction process of the film forming agent becomes unstable, and a large amount of unnecessary impurities are generated. Therefore, there is a suitable buffered pH range on the basis of the concentration of strontium ions and phosphate ions in technical solution of present invention. Within such pH range, the forming process of the chemical conversion film formed by film forming treatment agent coated on the surface of magnesium alloy is relatively stable and reliable, and the generation of unnecessary impurities can be avoided to the maximum extent.

Further, the ratio of the strontium ions to the phosphate ions is 1:(0.2-0.9).

In the aqueous solution of the film forming treatment agent of the present invention, the molar ratio of strontium ions to phosphate ions is controlled to be 1:(0.2-0.9) in order to provide a best coordination balance between strontium ions and phosphate ions in aqueous solution, thereby match the molar ratio of strontium ions and phosphate ions in the hydroxy strontium phosphate $[Sr_{10}(PO_4)_6(OH)_2]$ in the composite chemical conversion film that is ultimately formed on the surface of magnesium alloys. In addition, controlling the molar ratio of strontium ions to phosphate ions within the above range can also effectively reduce the unnecessary harmful impurities that may be generated during the preparation of the chemical conversion film. In addition, it should be noted that although orthophosphate ions and other phosphate ions may coexist in a balanced manner in aqueous solutions, such equilibrium state promotes the combination of orthophosphate ions, hydroxide ions and strontium ions during the preparation of the film forming treatment agent of present invention to form a composite chemical conversion film mainly composed of hydroxy strontium phosphate $[Sr_{10}(PO_4)_6(OH)_2]$. Therefore, the mole number of orthophosphate ions in aqueous solution needs to be as close as possible to the mole number of phosphate.

Further, the strontium ions are derived from at least one of strontium nitrate, strontium chloride, strontium acetate, strontium borate, and strontium iodate.

Further, the strontium ions are derived from strontium nitrate.

Due to the high solubility of strontium nitrate in aqueous solution, the use of strontium nitrate can obtain an aqueous solution with a relatively high concentration of strontium ions, so that the preparation time of the film forming treatment agent can be shortened and then the film forming time of the chemical conversion film can be shortened. Meanwhile, the insoluble strontium salt impurities that may be generated during the preparation of the film forming treatment agent are greatly reduced, thereby improving the purity and quality of the film forming treatment agent.

Further, the phosphate ions are derived from at least one of ammonium dihydrogen phosphate, sodium phosphate, sodium hydrogen phosphate, potassium phosphate, and potassium hydrogen phosphate.

Further, the phosphate ions are derived from ammonium dihydrogen phosphate.

When phosphate dissolves in aqueous solution to form a solution, orthophosphate ions ($PO_4^{3-}$) form coexistence equilibrium with other different forms of acidified phosphate ions based on the pH value of the solution. For example, orthophosphate ions ($PO_4^{3-}$) form a coexistence equilibrium state with phosphate molecules ($H_3PO_4$), dihydrogen phosphate ions ($H_2PO_4^-$) and monohydrogen phosphate ions ($HPO_4^{2-}$). The main reasons of choosing ammonium dihydrogen phosphate as the source of phosphate ions are as follows: the ammonium ion has a large volume size and a relatively high solubility in water, so that precipitation is not easily generated, thereby avoiding the introduction of unnecessary harmful impurities in the film forming treatment agent.

Further, the aqueous solution contains an acidic buffering agent so that the pH value of the aqueous solution is 1.5-4.5.

Based on the above technical solution; the pH value of the aqueous solution is adjusted to 1.5-4.5 by adding acidic buffering agent. Meanwhile, the addition of acidic buffering agent to the aqueous solution is also intended to stabilize the pH of the film forming treatment agent.

Further, the acidic buffering agent is selected from at least one of nitric acid, sulfuric acid and organic acid.

The acidic buffering agent may use any one or more of nitric acid, sulfuric acid, and organic acids. Preferably, nitric acid is used as an acidic buffering agent for the reason that: nitric acid has a strong acidity; thereby can adjust the pH value of the reagent more effectively than the organic weak acid in the acid range; besides; nitric acid has a relatively higher stability and controllable reaction progress compared with hydrochloric acid and sulfuric acid.

Another object of the present invention is to provide a film forming process for forming composite chemical conversion film of magnesium alloy using the film forming treatment agent described above. A composite chemical conversion film of magnesium alloy with excellent corrosion resistance can be obtained through the film forming process; thereby providing better protection for the magnesium alloy. The film forming process is simple and easy to implement, and is suitable for large-scale application in related manufacturing fields.

Based on the above object of the invention, the present invention provides a film forming process for forming a composite chemical conversion film of magnesium alloy using the film forming treatment agent described above, including steps of:

(1) performing pretreatment on the surface of the magnesium alloy matrix;

(2) immersing the magnesium alloy matrix in a film forming treatment agent;

(3) taking out the magnesium alloy piece and drying it in air.

In the step (1), the pretreatment of the magnesium alloy matrix surface can be conducted by conventional pretreatment process.

In the step (2) of immersing the magnesium alloy matrix in the film forming treatment agent, since the film forming treatment agent contains strontium ions, phosphate ions, and reduced graphene oxides, when the film forming treatment agent contacts with the magnesium alloy matrix, a large amount of metallic magnesium ions ($Mg^{2+}$), hydrogen gas ($H_2$), and hydroxyl anions ($OH^-$) are released, and meanwhile, the pH value of the solution close to the magnesium alloy matrix greatly increases. The chemical reaction involved in the above process is as follows: $Mg+2H_2O \rightarrow Mg^{2+}+H_2+2OH^-$. The increased pH value of the solution close to the magnesium alloy matrix results in the formation of hydroxy strontium phosphate, which in turn forms a composite with the reduced graphene oxide and co-precipitates on the surface of the magnesium alloy matrix. The chemical reaction involved in the above process is as follows: $10Sr^{2+}+2OH^-+6PO_4^{3-} \rightarrow Sr_{10}(PO_4)_6(OH)_2$.

In the step (2), the film forming treatment agent contacts with the magnesium alloy matrix and forms a chemical conversion film layer containing the composite of strontium ions, phosphate ions, and reduced graphene oxide on the surface thereof. The film layer may be formed on or near the surface of the matrix to provide corrosion protection to the magnesium alloy matrix.

It should be noted that the main components of the film layer is the hydroxy strontium phosphate-reduced graphene oxide composite formed by strontium, phosphate and reduced graphene oxide, and optionally other impurities such as magnesium phosphate [$Mg_3(PO_4)_2$], magnesium hydroxide [$Mg(OH)_2$] and/or magnesium hydrogen phosphate [$MgHPO_4$].

Compared with the spraying or brushing method, in the above technical solutions, the magnesium alloy matrix is immersed in the film forming treatment agent so that the film forming treatment agent is coated on the surface of the magnesium alloy matrix, thereby can sufficiently form a complete composite chemical conversion film on the surface of the magnesium alloy matrix to avoid the harmful contact between the magnesium alloy matrix and the corrosion environment.

Further, the pretreatment of step (1) includes:

(1a) grinding;

(1b) ultrasonic-cleaning the magnesium alloy matrix with alcohol (95 wt. %) and acetone at room temperature, respectively, the cleaning time is 5-15 min.

In the step (1a), surface of the magnesium alloy matrix may be mechanically polished by sanding tool such as sandpaper.

Moreover, the pretreatment of step (1) further includes:

(1c) activating magnesium alloy matrix in concentrated phosphoric acid solution (85 wt. %) for 20-50 s;

(1d) cleaning magnesium alloy matrix in citric acid for 5-15 s;

(1e) reacting magnesium alloy matrix in dilute sodium hydroxide solution for 5-15 min under hydrothermal conditions of 80-150° C.;

(1f) cleaning with citric acid for 5-15 s at room temperature;

(1g) ultrasonic-cleaning magnesium alloy matrix with alcohol and acetone at room temperature, respectively, the cleaning time is 5-15 min.

Further, in the step (2), the film forming temperature is from room temperature to 100° C., and the immersion time is 5-15 min.

Since the reaction temperature at which the film forming treatment agent of the present invention transforms into the composite chemical conversion film is lower than the boiling point of water under normal atmospheric pressure, the film forming temperature needs to be controlled within the range of room temperature to 100° C. and the immersion time is controlled to be 5-15 min.

A chemical conversion film layer of hydroxy strontium phosphate-reduced graphene oxide composite can be formed on the surface of magnesium alloy matrix through the film forming process of the present invention. Since the reduced graphene oxide and hydroxy strontium phosphate are closely combined by physical adsorption and the hydroxy strontium phosphate-reduced graphene oxide composite has ultra-low solubility and is not easily dissolved in a strong acid environment, the composite chemical conversion film layer has super stability and is not easily dissolved in a strong acid environment, and thereby the corrosion resistance of the magnesium alloy is improved. The above composite chemical conversion film layer has better stability over a wider range of pH compared with a chemical conversion film whose main component is calcium phosphate.

The film forming treatment agent for a composite chemical conversion film for magnesium alloy according to the present invention does not contain chromate and fluoride. Compared with conventional chromate film forming treatment agent; the film forming treatment agent of the present invention is non-toxic and has a low degree of environmental impact. It is an environmentally friendly product and meets the environmental protection standards in industrial production field.

In addition, the chemical film layer formed on the surface of the magnesium alloy by the film forming treatment agent for a composite chemical conversion film for magnesium alloy according to the present invention has good corrosion resistance and excellent stability.

In addition, the film forming treatment agent for a composite chemical conversion film for magnesium alloy according to the present invention is low-cost and can be widely applied to the field of industrial production.

In addition, the film forming process for magnesium alloy according to present invention is simple and easy to implement, and is suitable for stable production on various production lines.

DETAILED DESCRIPTION

Figure 1:
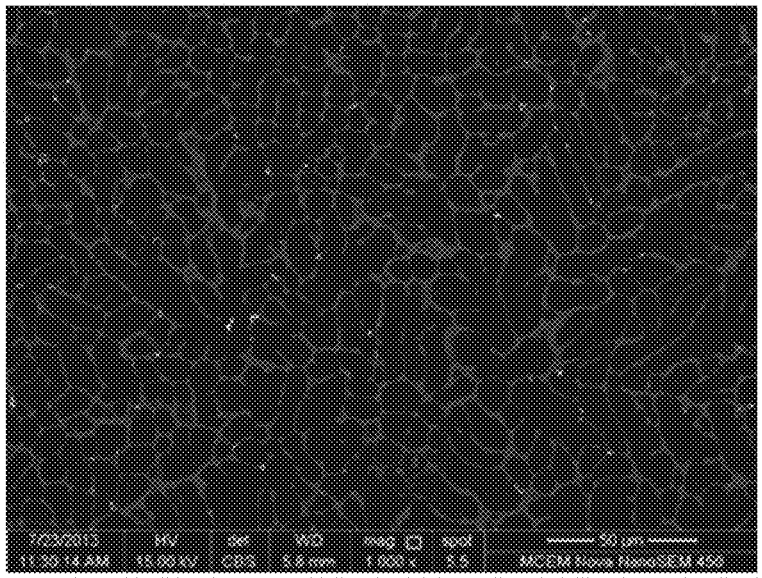
FIG. 1 shows microstructure of the surface of magnesium alloy matrix of Example C2 before pretreatment.

The film forming treatment agent for a composite chemical conversion film for magnesium alloy and the film forming process according to present invention will be further explained with reference to the accompanying drawings and specific Examples, while the technical solutions of present invention are not limited by the explanations.

Examples C1-C5

The composite chemical conversion films for magnesium alloy of Examples C1-C5 are prepared by the following steps:

(1) performing pretreatment on the surface of the magnesium alloy matrix, the pretreatment including:

(1a) grinding the surface of magnesium alloy with 1200 #silicon carbide sandpaper and polishing;

(1b) ultrasonic-cleaning the magnesium alloy matrix with alcohol (95 wt. %) and acetone at room temperature, respectively, the cleaning time is 5-15 min.

In Examples C3, C4 and C5, the following steps are added after step (1b);

(1c) activating the magnesium alloy matrix in concentrated phosphoric acid solution (85 wt. %) for 20-50 s;

(1d) cleaning the magnesium alloy matrix in citric acid for 5-15 s;

(1e) reacting the magnesium alloy matrix in dilute sodium hydroxide solution for 5-15 min under hydrothermal conditions of 80-150° C.;

(1f) cleaning with citric acid for 5-15 s at room temperature;

(1g) ultrasonic-cleaning the magnesium alloy matrix with alcohol and acetone at room temperature, respectively, the cleaning time is 5-15 min.

(2) immersing the magnesium alloy matrix in a film forming treatment agent, components of the film forming treatment agent comprise an aqueous solution and a reduced graphene oxide insoluble to the aqueous solution. The aqueous solution comprises strontium ions at 0.1 mol/L to 2.5 mol/L and phosphate ions at 0.06 mol/L to 1.5 mol/L, the pH value of the aqueous solution is 1.5-4.5. The concentration of the reduced graphene oxide is 0.1 mg/L to 5 mg/L. The molar ratio of strontium ions to phosphate ions is controlled to be 1:(0.2-0.9) and the chemical composition in aqueous solutions and the pH value of aqueous solutions are shown in Table 1. The film forming temperature is from room temperature to 100° C., and the immersion time is 5-15 min.

(3) taking out the magnesium alloy piece and drying with a blow dryer in the air, and a composite chemical conversion film is formed on the magnesium alloy matrix.

In the above step (2), the strontium ions in the aqueous solution of the film forming treatment agent may be selected from at least one of strontium nitrate, strontium chloride, strontium acetate, strontium borate, and strontium iodate, wherein strontium nitrate is preferred. The acid ions may be selected from at least one of ammonium dihydrogen phosphate, sodium phosphate, sodium hydrogen phosphate, potassium phosphate, and potassium hydrogen phosphate, wherein ammonium dihydrogen phosphate is preferred. In addition, an acidic buffering agent may be added to the aqueous solution of the film forming treatment agent so that the pH value of the aqueous solution is 1.5-4.5. The acidic buffering agent may be at least one of nitric acid, sulfuric acid and organic acid, wherein nitric acid is preferred.

It should be noted that the relevant process parameters in the above steps (1) to (3) are shown in Table 2.

Table 1 shows the concentration of each chemical component and the pH value of the film forming treatment agent for immersing the magnesium alloy matrixes of Examples C1-C5.

TABLE 1

| Number | magnesium alloy matrix | strontium ion (mol/L) | phosphate ions(mol/L) | ratio of strontium ions to phosphate ions | reduced graphene oxide (mg/L) | acidic buffering agent | pH value |
|---|---|---|---|---|---|---|---|
| C1 | Magnesium alloy AZ31 (Mg—3Al—1Zn—0.2Mn) | strontium phosphate 0.1 | ammonium dihydrogen phosphate 0.06 | 1:0.5 | 0.5 | nitric acid | 3.0 |

TABLE 1-continued

| Number | magnesium alloy matrix | strontium ion (mol/L) | phosphate ions(mol/L) | ratio of strontium ions to phosphate ions | reduced graphene oxide (mg/L) | acidic buffering agent | pH value |
|---|---|---|---|---|---|---|---|
| C2 | Magnesium alloy Mg—1Al—1Zn—0.5Ca | strontium chloride 0.5 | potassium phosphate 0.25 | 1:0.5 | 2 | hydrochloric acid | 2.5 |
| C3 | Magnesium alloy Mg—1Al—1Zn—0.5Ca | strontium iodate 1 | ammonium dihydrogen phosphate, potassium hydrogen phosphate 0.9 | 1:0.9 | 3 | sulfuric acid | 1.8 |
| C4 | Magnesium alloy Mg—1Ca—0.5Mn | strontium acetate 0.5 | sodium phosphate 0.1 | 1:0.2 | 1 | nitric acid | 2.5 |
| C5 | Magnesium alloy AZ91D (Mg—9.1Al—0.7Zn—0.2Mn) | strontium borate 2.5 | sodium hydrogen phosphate 1.0 | 1:0.4 | 5 | carbonic acid, lactic acid | 4.5 |

It should be noted that the number in front of the corresponding element of each magnesium alloy matrix in Table 1 indicates the mass percentage of the element, and Mg is the balance amount. For example, Mg-3Al-1Zn-0.2Mn indicates that the content of Al is 3 wt. %, the content of Zn is 1 wt. %, the content of Mn is 0.2 wt. %, and balance of Mg.

Table 2 shows specific parameters of the film forming process of the composite conversion film for magnesium alloys of Examples C1-C5.

TABLE 2

| | Step (1e) | | Step (2) | |
|---|---|---|---|---|
| | hydrothermal | | | |
| Number | temperature (° C.) | reaction time (min) | Film forming temperature | immersion time |
| C1 | — | — | 100 | 5 |
| C2 | 150 | 15 | 80 | 5 |
| C3 | — | — | 40 | 10 |
| C4 | 80 | 10 | 60 | 15 |
| C5 | 100 | 5 | Room temperature | 5 |

Note:
"—" means hydrothermal treatment without step (1e).

Figure 2:
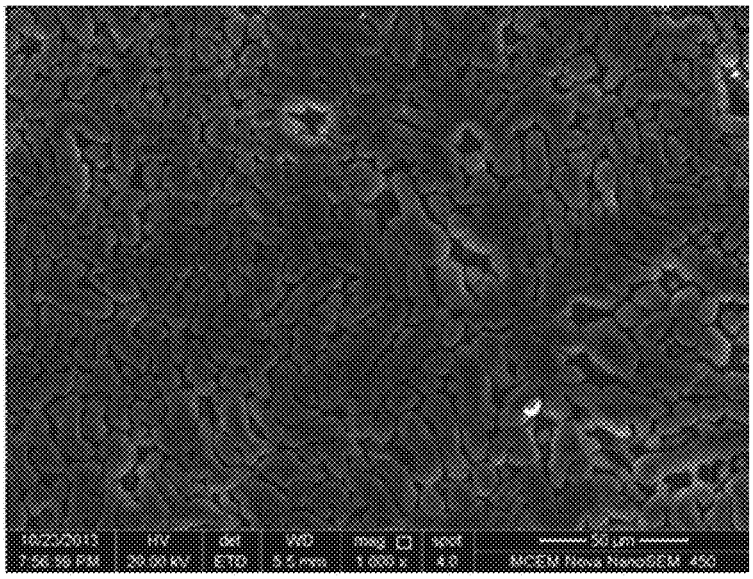
FIG. 2 shows microstructure of the surface of magnesium alloy matrix of Example C2 after pretreatment.
Figure 3:
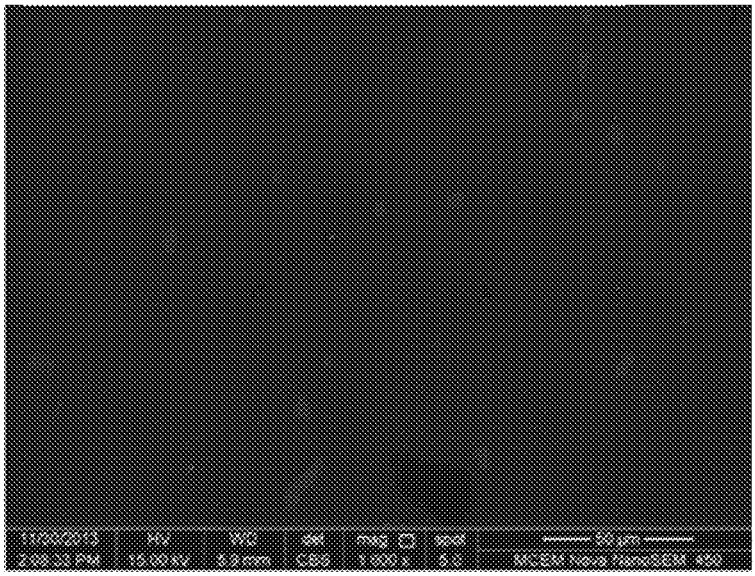
FIG. 3 shows microstructure of the surface of magnesium alloy matrix of Example C4 before pretreatment.
Figure 4:
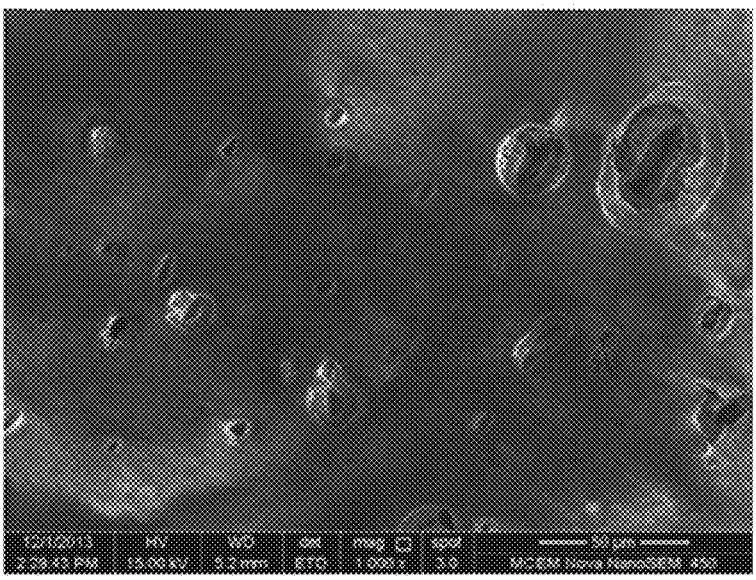
FIG. 4 shows microstructure of the surface of magnesium alloy matrix of Example C4 after pretreatment.
Figure 5:
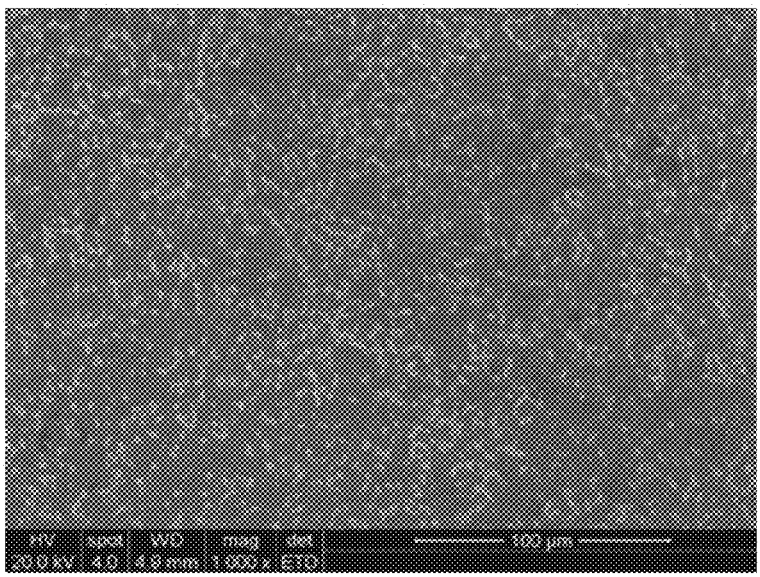
FIG. 5 shows microstructure of the surface of magnesium alloy matrix of Example C5 before pretreatment.
Figure 6:
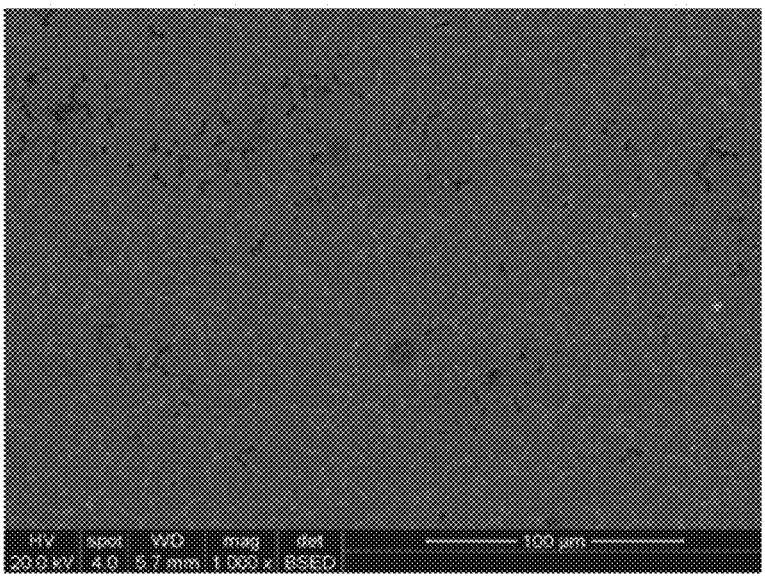
FIG. 6 shows microstructure of the surface of the magnesium alloy matrix of Example C5 after pretreatment.

FIGS. 1 and 2 show the microstructure of the surface of the magnesium alloy matrix of Example C2 before and after the pretreatment, respectively. FIGS. 3 and 4 show the microstructure of the surface of the magnesium alloy matrix of Example C4 before and after the pretreatment, respectively. FIGS. 5 and 6 show the microstructure of the surface of the magnesium alloy matrix of Example C5 before and after the pretreatment, respectively.

As shown in FIGS. 1, 3 and 5, the bright regions indicate that the surfaces of Example C2, Example C4 and Example C5 contain the intermetallic compounds of elements Ca, Mn and Al. After step (1), as can be seen from the microstructures shown in FIGS. 2, 4 and 6, the intermetallic compounds on the surface of the magnesium alloy are effectively removed, and the surfaces of these magnesium alloy matrice contain only magnesium element.

Figure 7:
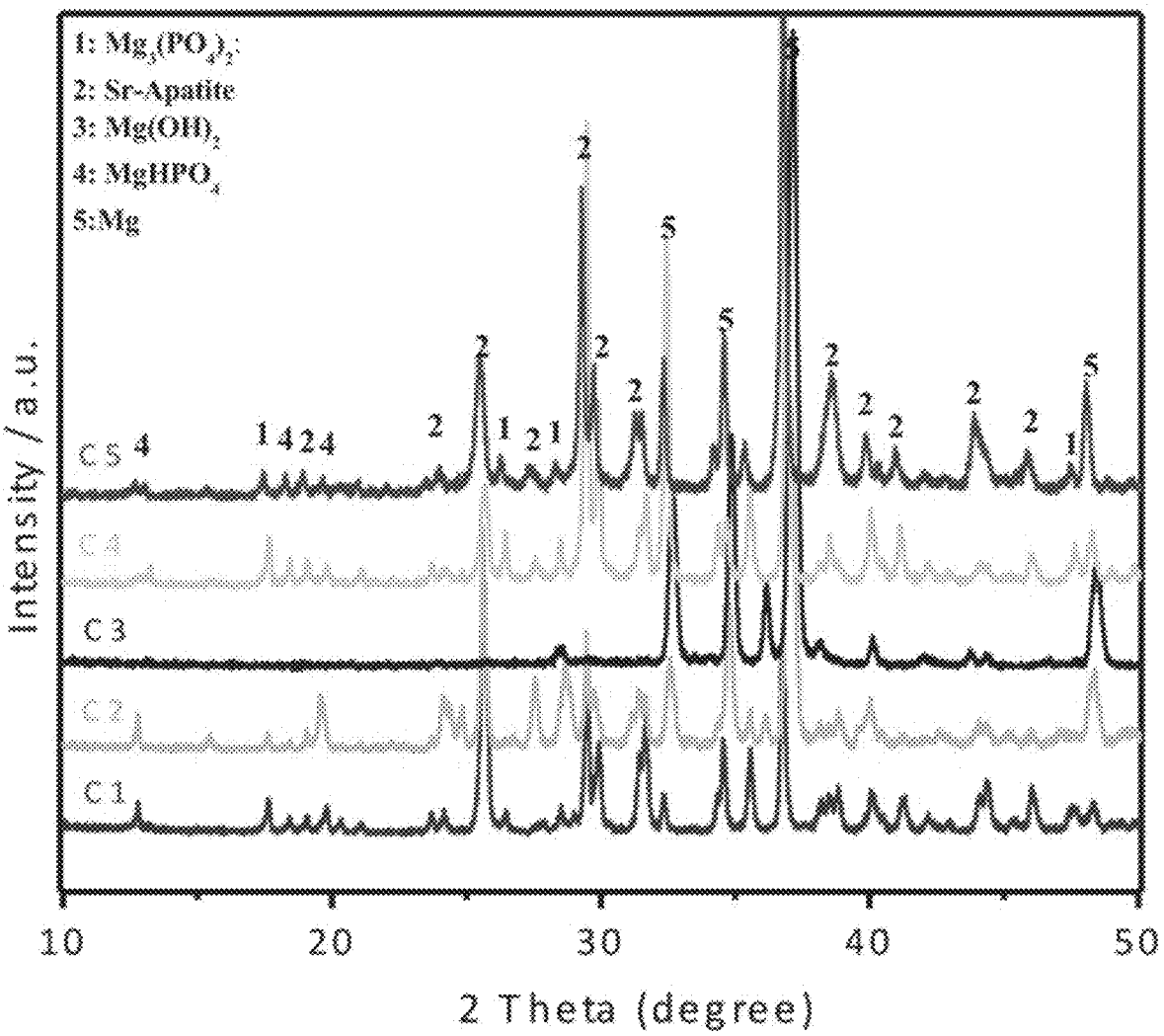
FIG. 7 is X-ray diffraction pattern of the composite chemical conversion film on the surface of magnesium alloys of Examples C1-C5.
Figure 8:
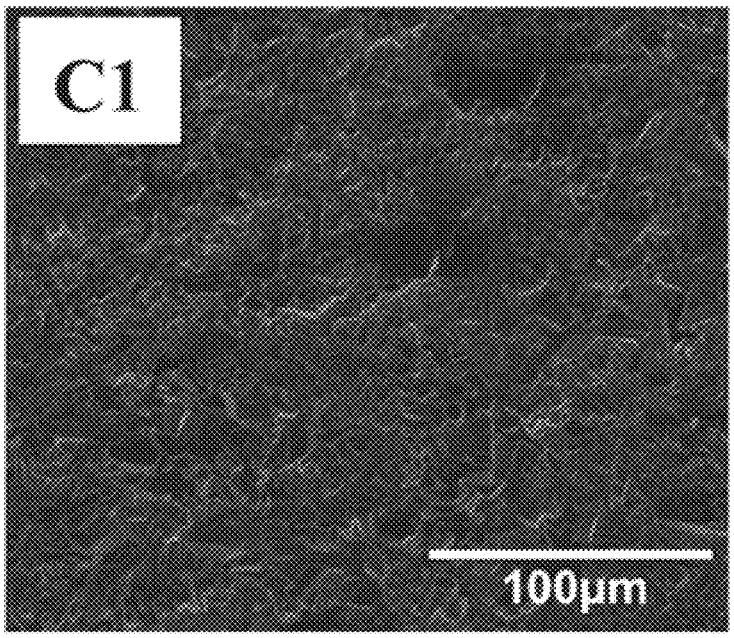
FIGS. 8-12 are scanning electron micrographs of the surfaces of magnesium alloys of Examples C1-C5, respectively.
Figure 9:
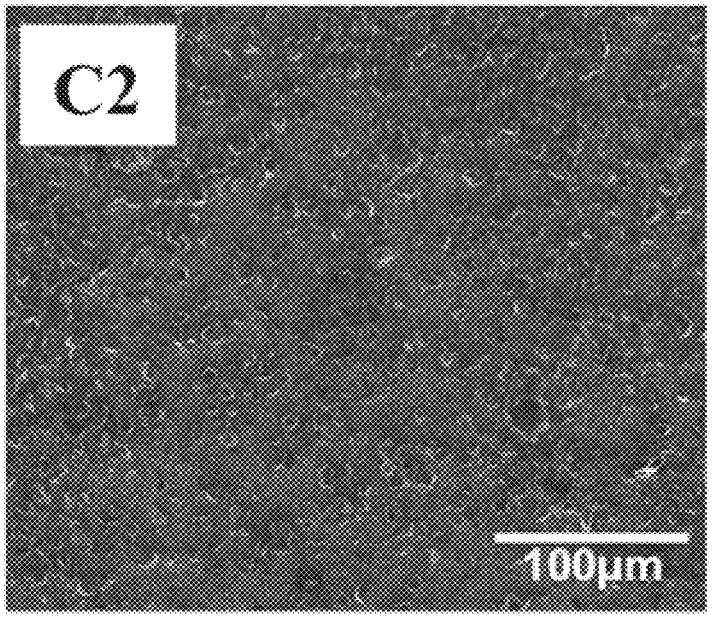
Figure 10:
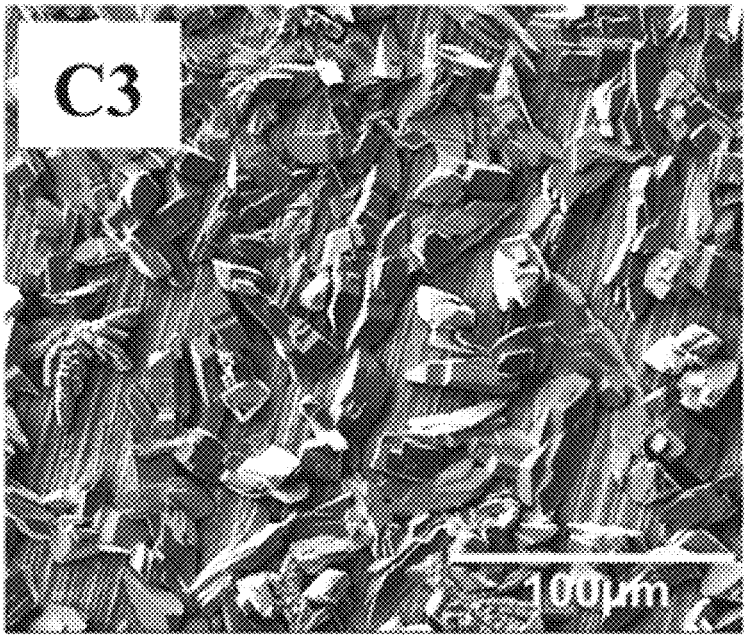
Figure 11:
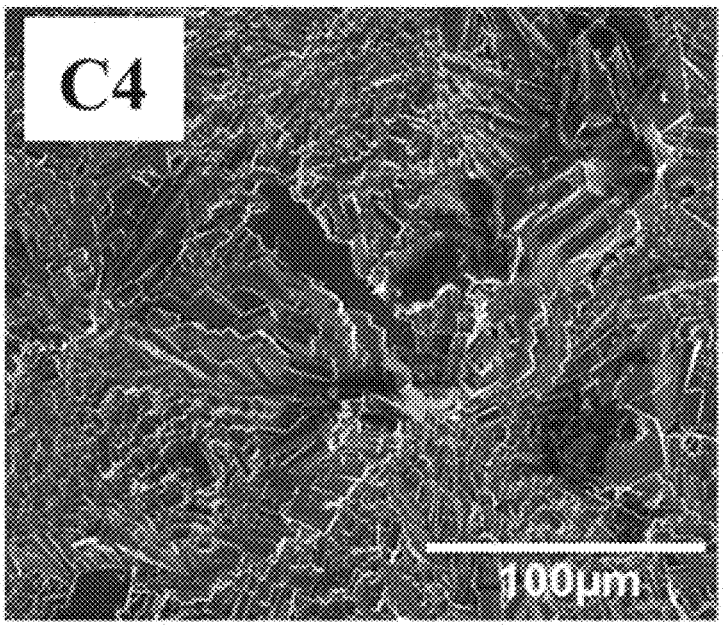
Figure 12:
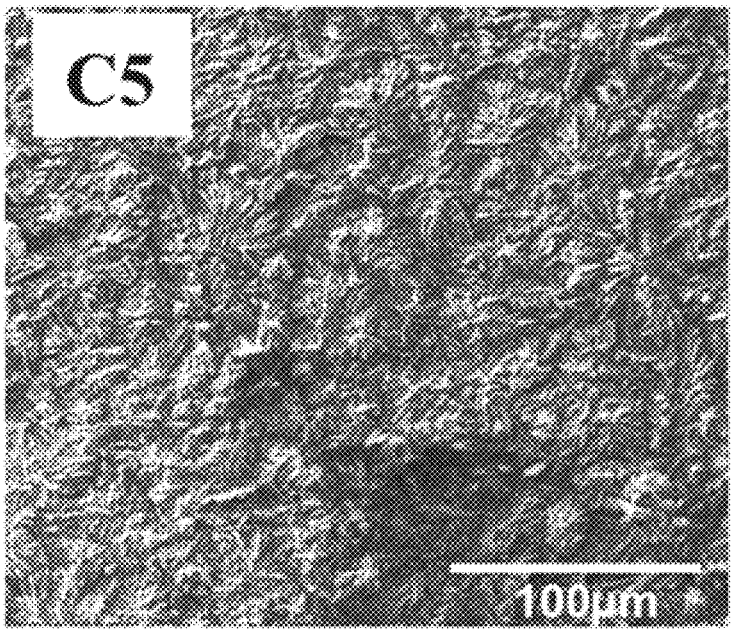
Figure 13:
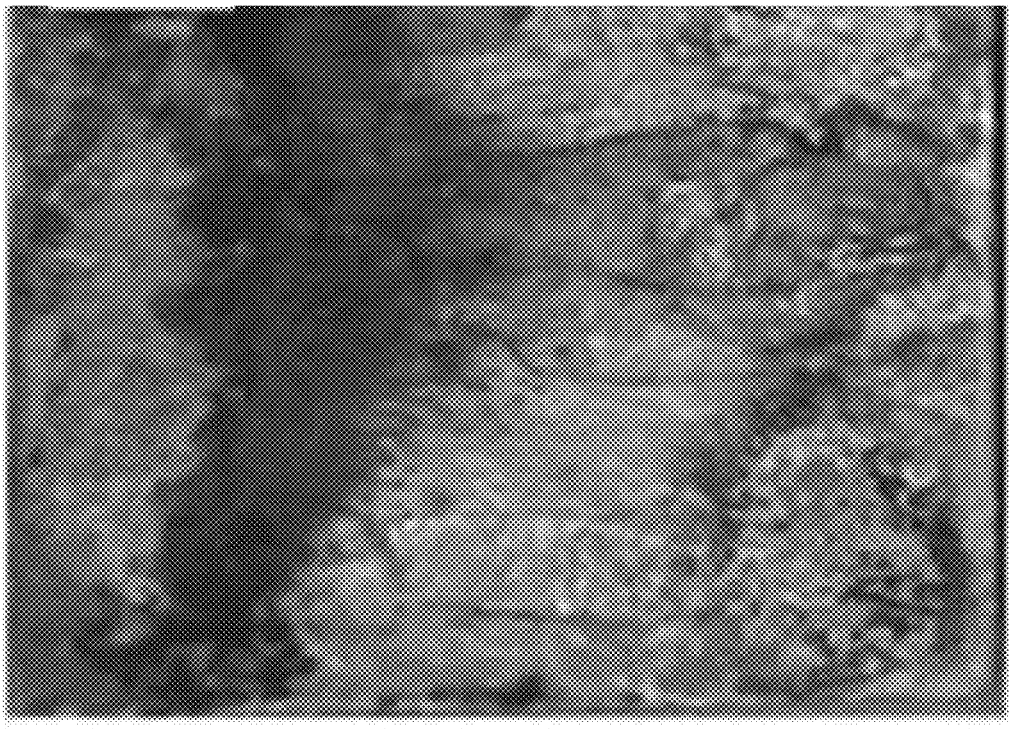
FIGS. 13-17 are microstructure photographs of magnesium alloy surfaces of Examples C1-C5 after immersed in sodium chloride solution for 5 days, respectively.

FIG. 7 shows X-ray diffraction pattern of the composite chemical conversion film on the surface of magnesium alloys of Examples C1-C5.

Examples C1-C5 were sampled, and the composition of the composite chemical conversion film on the surface of the magnesium alloys of Examples C1-C5 was determined by X-ray diffraction. As shown in FIG. 7, in addition to the magnesium element, the main components in Examples C1-C5 are strontium-containing salts and hydroxy strontium phosphate, and the minor components thereof are magnesium phosphate, magnesium hydroxide, magnesium hydrogen phosphate and the like.

Examples C1-C5 and Comparative Examples D1-D3 were sampled, wherein Comparative Examples D1-D3 are uncoated Mg—Al—Zn—Ca-based magnesium alloys, uncoated AZ910 magnesium alloys and uncoated aluminum alloys 6061, respectively. Samples in Examples C1-C5 and Comparative Examples D1-D3 were immersed in a sodium chloride solution having a concentration of 0.1 mol/L for 5 days at room temperature. After immersing for 5 days, samples in Examples and Comparative Examples were taken out and photographed by an optical microscope. Meanwhile, the weight losses due to corrosion were measured, and the weight loss rates are shown in Table 3.

TABLE 3

| Number | C1 | C2 | C3 | C4 | C5 | D1 | D2 | D2 |
|---|---|---|---|---|---|---|---|---|
| weight loss rate ($mg/cm^3 \cdot h$) | 0.13 ± 0.04 | 0.02 ± 0.003 | 0.065 ± 0.015 | 0.085 ± 0.014 | 0.12 ± 0.002 | 0.61 ± 0.01 | 0.29 ± 0.02 | 0.078 ± 0.014 |

FIGS. 8-12 show scanning electron micrographs of the surfaces of magnesium alloys of Examples C1-C5, respectively. As can be seen from FIGS. 8-12, the surfaces of Examples C1-C5 are densely and completely covered by regular columnar strontium phosphate crystal particles.

Figure 18:
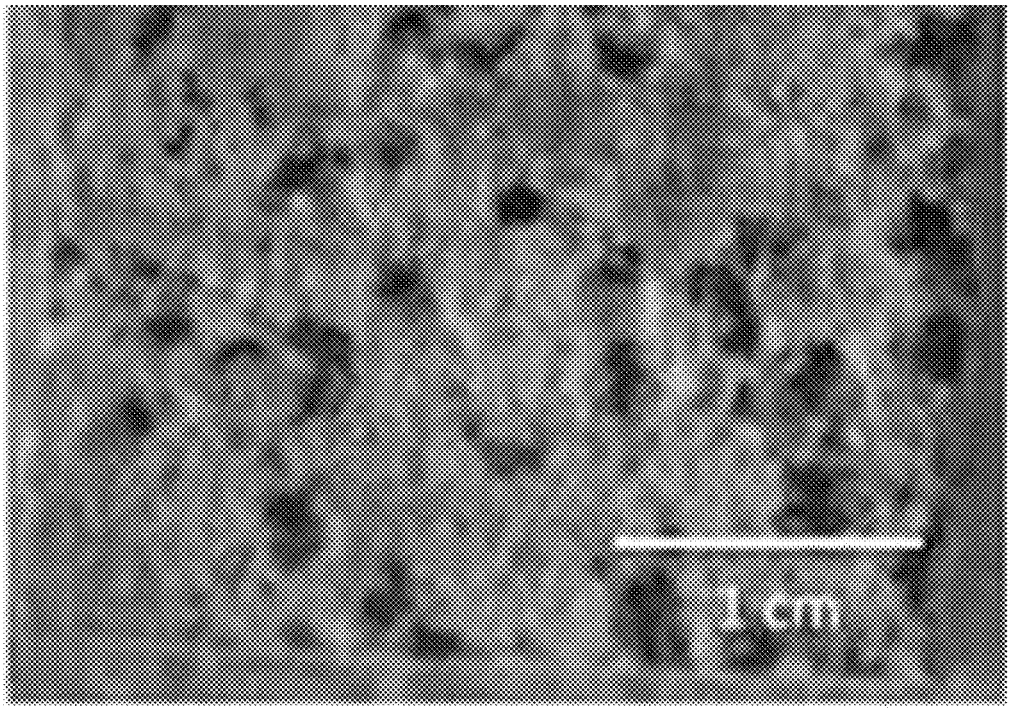
FIG. 18 is a microstructure photograph of magnesium alloy surface of Comparative Example D1 after immersed in sodium chloride solution for 5 days.
Figure 19:
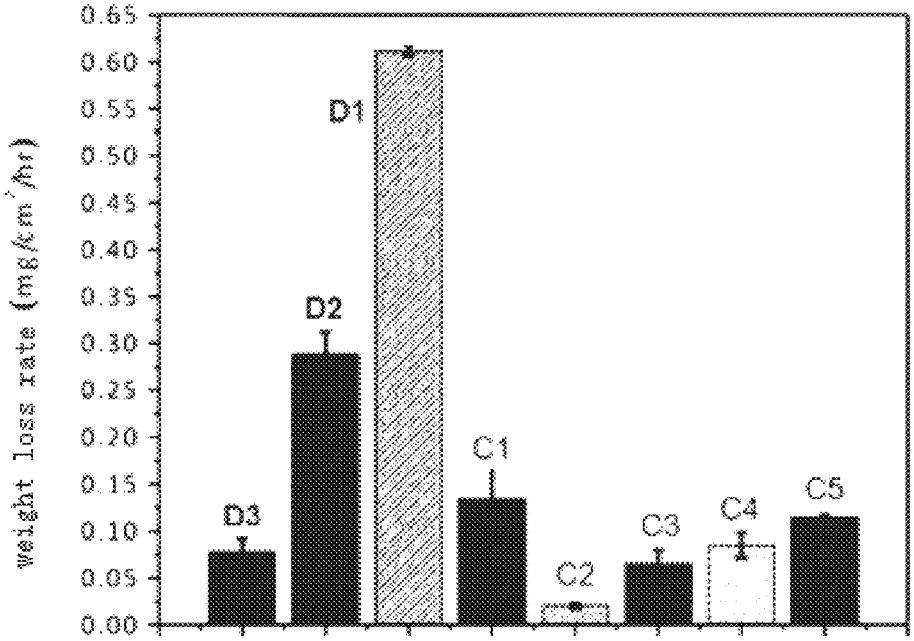
FIG. 19 is a graph comparing the weight loss rates of the magnesium alloys of Examples C1-C5 and of the magnesium alloys of Comparative Examples D1-D3 after immersed in sodium chloride solution for 5 days.

FIGS. 13-17 show microstructure photographs of magnesium alloy surfaces of Examples C1-C5 after immersed in sodium chloride solution for 5 days, respectively. FIG. 18 shows the microstructure photograph of magnesium alloy surface of Comparative Example D1 after immersed in sodium chloride solution for 5 days. FIG. 19 shows comparison results of the weight loss rate of the magnesium alloys of Examples C1-C5 and of the magnesium alloys of Comparative Examples D1-D3 after immersed in sodium chloride solution for 5 days.

According to Table 3 and FIG. 19, although the magnesium alloys of Examples C1-C5 were immersed in a corrosive solution for 5 days, the weight loss rate thereof was much lower than that of Comparative Example D1 (uncoated Mg—Al—Zn—Ca-based magnesium alloys) and Comparative Example D2 (uncoated AZ91 D magnesium alloys). Therefore, compared with the uncoated magnesium alloys, the corrosion resistance of the magnesium alloy in the Examples is significantly improved due to the coated composite chemical conversion film, which improves the corrosion resistance of the magnesium alloy. In particular, the weight loss rate of the magnesium alloys of Examples C2-C3 is even lower than that of Comparative Example D3 (the existing aluminum alloy 6061), which further demonstrates that the magnesium alloy of the present invention has excellent corrosion resistance and is not easily corroded by corrosive liquid.

Figure 14:
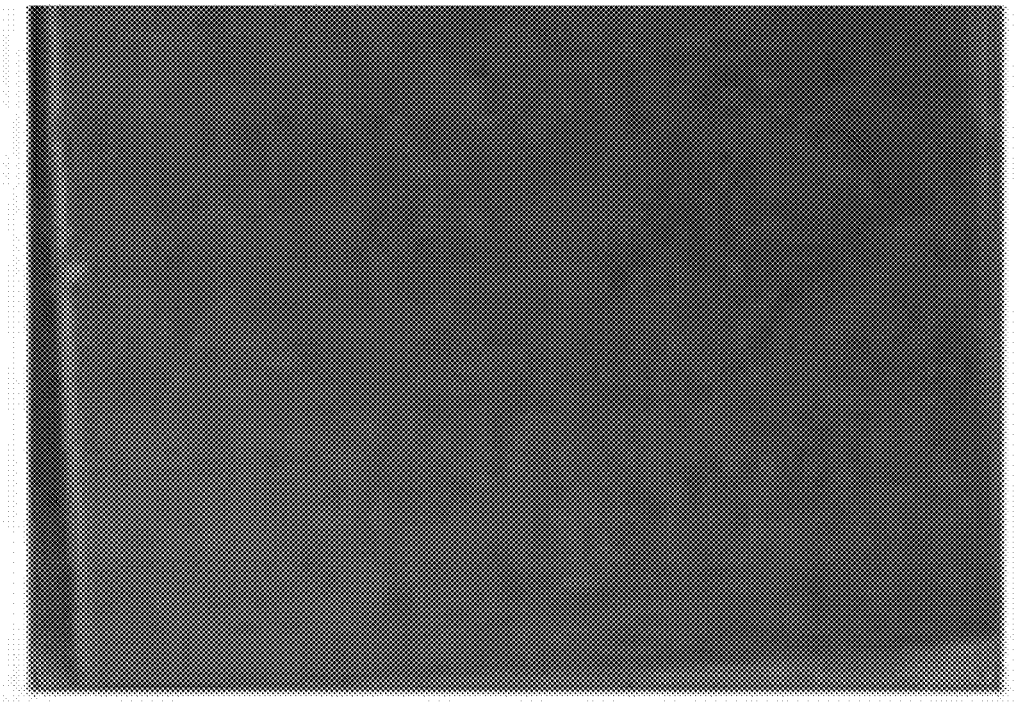
Figure 15:
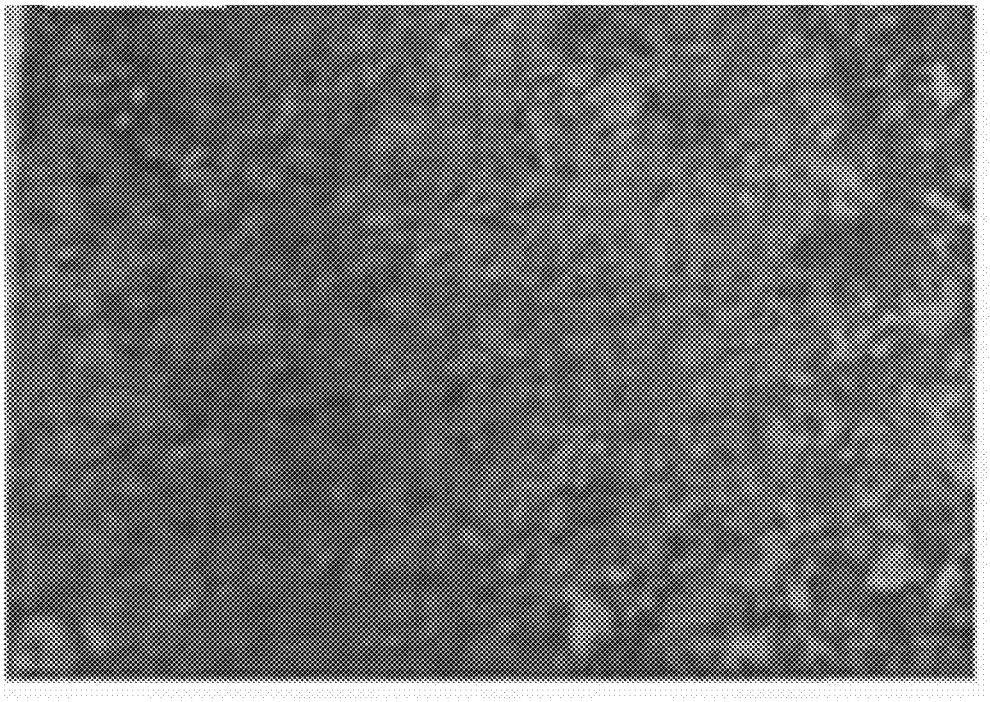
Figure 16:
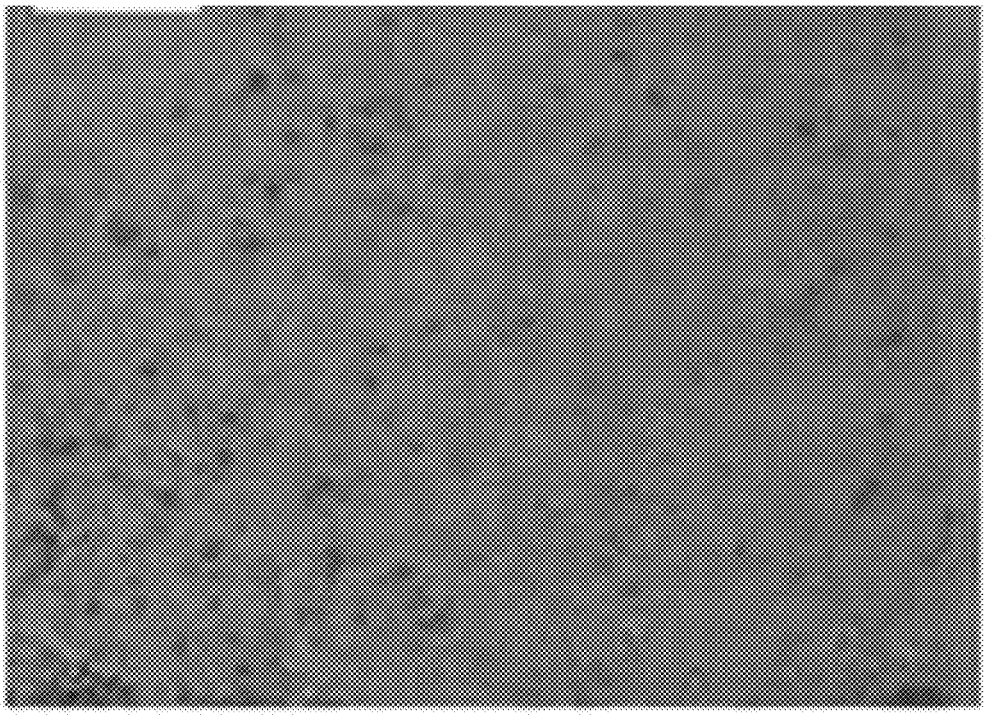
Figure 17:
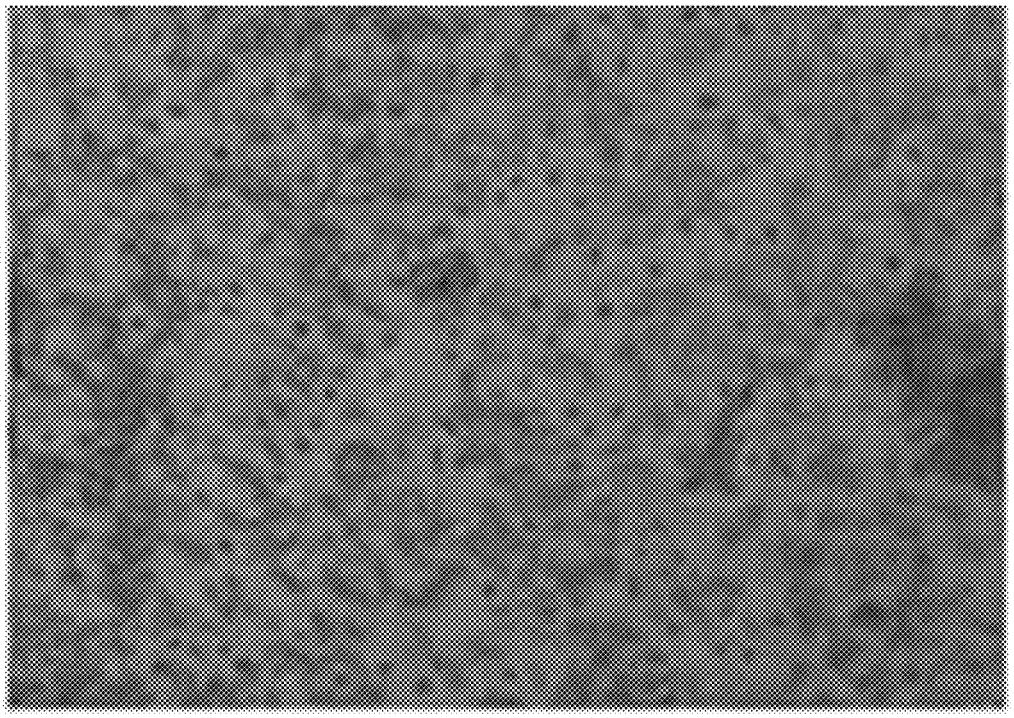

As shown in FIGS. 13-17, no severe corrosion occurred on the surfaces of the magnesium alloys of Examples C1-C5 after immersed in the sodium chloride solution for 5 days. Referring specifically to FIG. 14, the surface of the magnesium alloy of Example C2 has substantially no corrosion and no significant change. On the other hand, referring specifically to FIG. 18, severe corrosion occurred on the surface of Comparative Example D1 (bare magnesium alloy Mg—Al—Zn—Ca), and precipitations of corrosion products covered on the surface of the magnesium alloy. It can also be seen from the comparison of the microstructures shown in FIGS. 13-17 and FIG. 18 that coated magnesium alloys has better corrosion resistance.

It should be noted that the above is only specific Examples of present invention. It is obvious that present invention is not limited to the above Examples, and there are many similar changes. All variations that a person skilled in the art derives or associates directly from the disclosure of present invention shall fall within the protection scope of present invention.

The invention claimed is:

1. A film forming treatment agent for a composite chemical conversion film for magnesium alloy, comprising:

an aqueous solution having a pH value of 1.5-4.5, wherein the aqueous solution comprises strontium ions at a concentration of 0.1 mol/L to 2.5 mol/L and phosphate ions at a concentration of 0.06 mol/L to 1.5 mol/L, wherein the phosphate ions are derived from at least one selected from the group consisting of ammonium dihydrogen phosphate, sodium phosphate, sodium hydrogen phosphate, potassium phosphate, and potassium hydrogen phosphate; and a reduced graphene oxide insoluble to the aqueous solution, wherein the reduced graphene oxide has a concentration of 0.1 mg/L to 5 mg/L; and wherein the film forming treatment agent forms a composite chemical conversion film on the surface of a magnesium alloy substrate, and the film forming treatment agent does not contain chromate and fluoride.

2. The film forming treatment agent for a composite chemical conversion film for magnesium alloy according to claim 1, wherein a ratio of the strontium ions to the phosphate ions ranges from 1:0.2 to 1:0.9.

3. The film forming treatment agent for a composite chemical conversion film for magnesium alloy according to claim 1, wherein the strontium ions are derived from at least one selected from the group consisting of strontium nitrate, strontium chloride, strontium acetate, strontium borate, and strontium iodate.

4. The film forming treatment agent for a composite chemical conversion film for magnesium alloy according to claim 3, wherein the strontium ions are derived from strontium nitrate.

5. The film forming treatment agent for a composite chemical conversion film for magnesium alloy according to claim 1, wherein the phosphate ions are derived from ammonium dihydrogen phosphate.

6. The film forming treatment agent for a composite chemical conversion film for magnesium alloy according to claim 1, wherein the aqueous solution further comprises an acidic buffering agent.

7. The film forming treatment agent for a composite chemical conversion film for magnesium alloy according to claim 6, wherein the acidic buffering agent is selected from at least one selected from the group consisting of nitric acid, sulfuric acid and organic acid.

8. A film forming process for forming composite chemical conversion film of magnesium alloy using the film forming treatment agent according to claim 1, comprises the steps of:

(1) performing pretreatment on the surface of a magnesium alloy matrix;

(2) immersing the magnesium alloy matrix in the film forming treatment agent; and (3) taking out the magnesium alloy matrix and drying in air.

9. The film forming process according to claim 8, wherein the pretreatment of the step (1) comprises:

(1a) polishing; and (1b) ultrasonic-cleaning the magnesium alloy matrix with alcohol and acetone, respectively, at room temperature.

10. The film forming process according to claim 9, wherein the pretreatment of the step (1) further comprises:

(1c) activating the magnesium alloy matrix in a concentrated phosphoric acid solution;

(1d) cleaning the magnesium alloy matrix in citric acid;

(1e) allowing the magnesium alloy matrix to react in a dilute sodium hydroxide solution for 5-15 min under a hydrothermal condition of 80-150° C.;

(1f) cleaning with citric acid at room temperature; and (1g) ultrasonic-cleaning the magnesium alloy matrix with alcohol and acetone, respectively, at room temperature.

11. The film forming process according to claim 8, wherein in the step (2), film forming temperature is from room temperature to 100° C., and immersion time is 5-15 min.

* * * * *